US008508139B2

(12) United States Patent
Baaijens

(10) Patent No.: US 8,508,139 B2
(45) Date of Patent: Aug. 13, 2013

(54) SCENE SETTING CONTROL FOR TWO LIGHT GROUPS

(75) Inventor: Johannes Petrus Wilhelmus Baaijens, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 348 days.

(21) Appl. No.: 12/747,525

(22) PCT Filed: Dec. 16, 2008

(86) PCT No.: PCT/IB2008/055321

§ 371 (c)(1),
(2), (4) Date: Jun. 11, 2010

(87) PCT Pub. No.: WO2009/081329

PCT Pub. Date: Jul. 2, 2009

(65) Prior Publication Data

US 2010/0277106 A1 Nov. 4, 2010

(30) Foreign Application Priority Data

Dec. 20, 2007 (EP) ..... 07123858

(51) Int. Cl.
*H05B 37/02* (2006.01)

(52) U.S. Cl.
USPC ..... 315/169.3; 315/312; 315/294; 315/292; 315/316

(58) Field of Classification Search
USPC ..... 315/169.3, 312, 313, 316–320, 291, 315/292, 294, 295
See application file for complete search history.

(56) References Cited

U.S. PATENT DOCUMENTS

| | | | | |
|---|---|---|---|---|
| 4,095,139 | A * | 6/1978 | Symonds et al. | 315/153 |
| 4,727,296 | A | 2/1988 | Zaharchuk et al. | |
| 4,924,151 | A * | 5/1990 | D'Aleo et al. | 315/295 |
| 5,530,322 | A * | 6/1996 | Ference et al. | 315/295 |
| 6,118,231 | A | 9/2000 | Geigninger et al. | |
| 2004/0183475 | A1 | 9/2004 | Boulouednine et al. | |
| 2006/0076908 | A1 | 4/2006 | Morgan et al. | |

FOREIGN PATENT DOCUMENTS

WO 2006008464 A2 1/2006

* cited by examiner

*Primary Examiner* — Daniel D Chang
(74) *Attorney, Agent, or Firm* — John F. Salazar; Mark L. Beloborodov

(57) ABSTRACT

A lighting system (200) includes light sources (220) configured to provide light; and a controller (210) configured to divide the light sources (220) into a focus group (310) including focus light sources for providing main light and a surrounding group (320) including surrounding light sources for providing background light. The focus light sources have individual focus intensity levels related to each other according to a first relationship, and the surrounding light sources have individual surrounding intensity levels related to each other according to a second relationship. The controller (210) may be further configured to change a ratio between the focus and surrounding groups without changing the first and second relationships, such as by interpolation or multiplying by a factor at least one of the individual focus intensity levels and the individual surrounding intensity levels. The controller (210) may also be configured to change the total intensity without changing the ratio, and the first and second relationships.

12 Claims, 8 Drawing Sheets

SCENE SETTING CONTROL FOR TWO LIGHT GROUPS

The present invention relates to devices, methods and systems for controlling light sources grouped in at least two groups to change scene setting parameters while maintaining preset relationships among the light sources.

Lighting systems are increasingly being used to provide an enriching experience and improve productivity, safety, efficiency and relaxation. Light systems are becoming more advanced, flexible and integrated. This holds especially for professional domains like the retail domain, but new lights or light systems will also enter the home domain. This change is stimulated by the advent of LED lighting (Light Emitting Diodes or Solid State lighting). It is expected that LED lighting systems will proliferate due to increased efficiency as compared to today's common light sources, as well as to the ease of providing light of changeable light attributes, such as color and intensity.

Advanced lighting sources and systems are able to provide light of desired attributes and preset light scenes. In a room with two or more light sources, several light scenes may be created. If these light sources are dimmable and the number of light sources increases, such as above five, then the number of possible scenes increases enormously. Traditionally, light scenes are created by setting the dimming or intensity level of each light fixture separately. Untrained users typically have difficulty to find the optimum setting, and control of individual light sources is tedious.

Advances in lighting control include independently controlling light sources as described in International Patent Publication WO 2006/008464 to Summerland, which is incorporated herein by reference in its entirety. Other lighting control systems include dividing a lighting network (including addressable light sources) into zones for easier control and creation of light scenes, including execution of lighting programs or scripts to provide desired scenes, as described in U.S. Patent Application Publication No. 2006/0076908 to Morgan which is incorporated herein by reference in its entirety. Further, U.S. Patent Application Publication No. 2004/0183475 to Boulouednine, which is incorporated herein by reference in its entirety, describes controlling two groups of light sources, where a first power source controls two lights sources of the first group for providing two colors, and a second power source controls a third lights source of the second group for providing a third color. One controller is provided for controlling both power sources, while a second controller is provided for controlling only the second power source.

Another lighting control system is described in U.S. Pat. No. 6,118,231 to Geiginger, which is incorporated herein by reference in its entirety, where the total luminosity or brightness in a room is adjusted by changing a 'volume' parameter; and the ratio between light intensities of two light sources or groups of light sources is adjusted by changing a 'balance' parameter. This is achieved by adding or subtracting a value dS to parameters of the two sets of light sources or groups. In particular, when dS is added to both sets ($dS_1=dS_2$), then the total brightness is increased with no change in the ratio, and when dS is added to one set and subtracted from another set ($dS1=-dS2$), than the ratio is changed with no change in overall brightness.

Despite such advances, there is a need for a more intuitive scene setting control systems and methods that enable fast and comfortable creation of light scenes by untrained users and avoid the tedious way of controlling individual light fixture settings.

Accordingly, there is a need for simple light control systems that control grouped light sources to change the light attributes of the light groups.

One object of the present systems and methods is to overcome the disadvantages of conventional control systems.

According to one illustrative embodiment, a lighting system includes light sources configured to provide light; and a controller configured to divide the light sources into a focus group including focus light sources for providing main light and a surrounding group including surrounding light sources for providing background light. The focus light sources have individual focus intensity levels related to each other according to a first relationship, and the surrounding light sources have individual surrounding intensity levels related to each other according to a second relationship. The controller may be further configured to change a ratio between the focus and surrounding groups without changing the first and second relationships, such as by interpolation or multiplying by a factor at least one of the individual focus intensity levels and the individual surrounding intensity levels. The controller may also be configured to change the total intensity without changing the ratio, and the first and second relationships. Alternatively or in addition, the controller may also be configured to change the light output of only one selected group, i.e., either the focus group or surroundings group, such as by interpolation or multiplying by a factor at least one of the individual intensity levels of the selected group.

Further areas of applicability of the present devices, systems and methods will become apparent from the detailed description provided hereinafter. It should be understood that the detailed description and specific examples, while indicating exemplary embodiments of the systems and methods, are intended for purposes of illustration only and are not intended to limit the scope of the invention.

These and other features, aspects, and advantages of the apparatus, systems and methods of the present invention will become better understood from the following description, appended claims, and accompanying drawing where:

The following description of certain exemplary embodiments is merely exemplary in nature and is in no way intended to limit the invention, its applications, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

The following description of the light control devices, systems and methods include situations related to dimming or changing intensity and/or color values of lights sources divided in groups, such as a focus group and a surrounding group, to provide a desired contrast or light effect that defines a particular scene(s). The devices, systems and methods are applicable to home spaces such as living room, kitchen, bed room, bathroom, hotel rooms, shops, and other residential, retail or commercial spaces.

Figure 1:
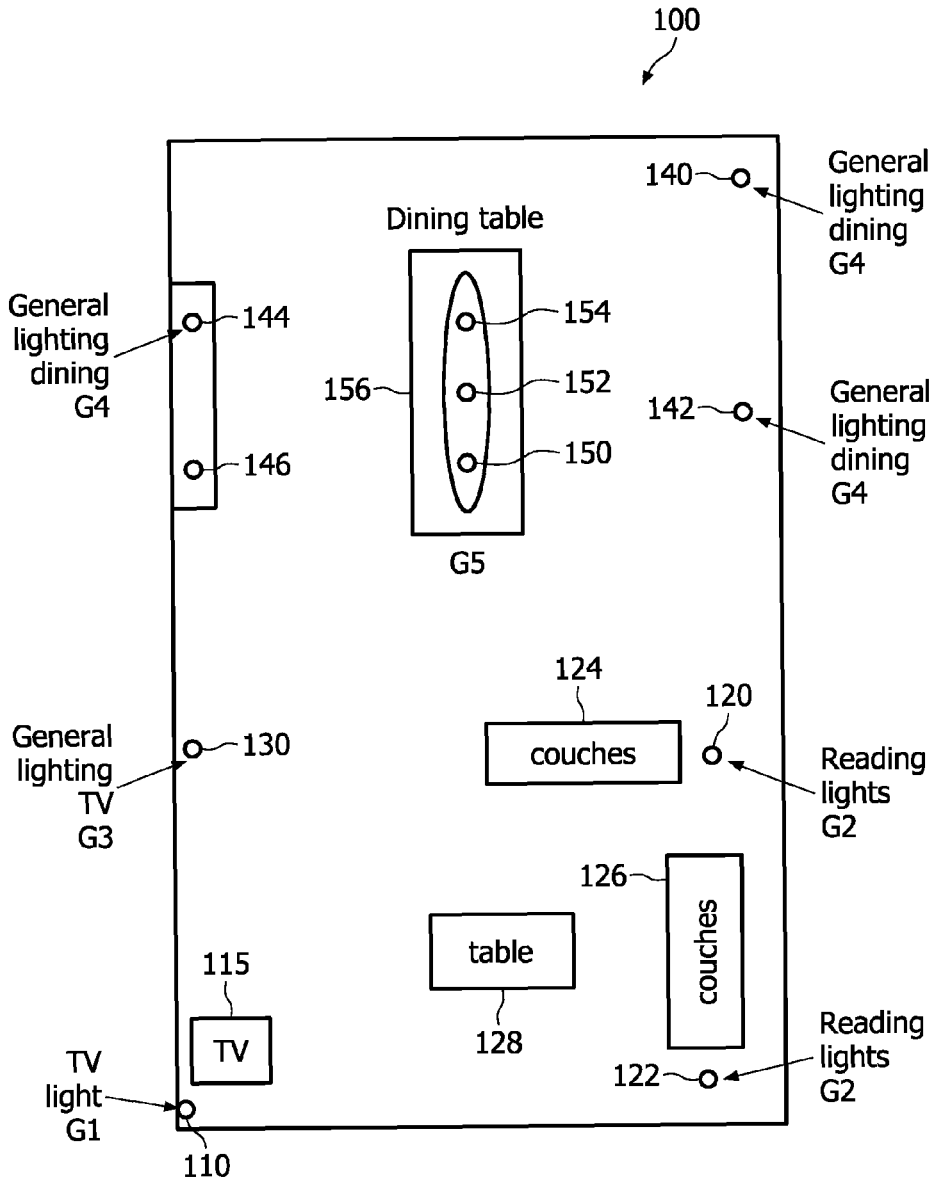
FIG. 1 shows a map of a space including light sources for illuminating light areas and providing light scenes according to one embodiment.

In a single space such as a living room 100 shown in FIG. 1, light fixtures are selectively connectable in groups, e.g., via any type of connection and/or network such as wired or wireless. The groups may be pre-selected and/or selectable by a user. Illustratively, five different groups G1, G2, G3, G4, G5 are shown in FIG. 1, each supporting a main light effect for a certain area in the space. For example, the following lamps or light fixtures may be grouped as follows: group G1 includes a television (TV) light 110 near a TV 115; group G2 includes reading lights 120, 122 near couches 124, 126 and/or a small table 128; group G3 includes general lighting of one or more lamps 130 for the TV area; group G4 includes general lighting of one or more lamps 140, 142, 144, 146 for a dining room area; and group G5 includes dining table lights 150, 152, 154 near a dining table 156. Of course any alternate or additional light sources or lamps may be provided for any room or space and grouped in various groups selectable by a user.

Figure 2:
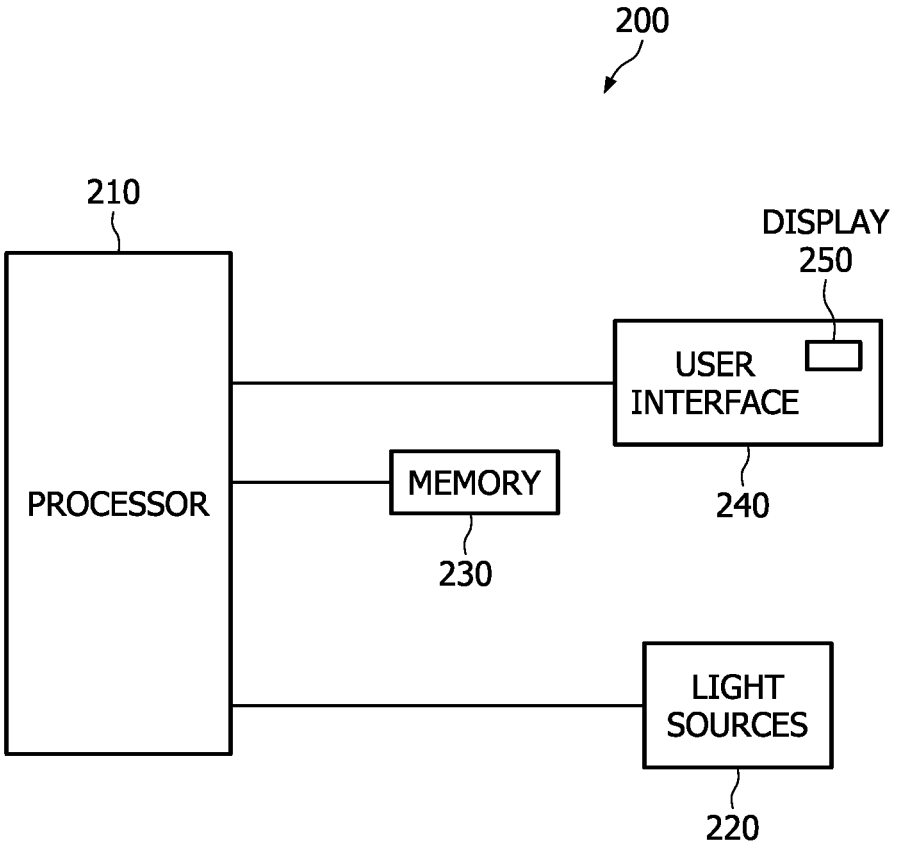
FIG. 2 shows an illustrative light control system according to one embodiment.

FIG. 2 shows a light control system 200 according to one embodiment that includes a processor 210 operationally coupled to and configured to control controllable light sources shown collectively as reference numeral 220. The processor 210 may also be operationally coupled to a memory 230 which stores various pre-sets, light scenes, scripts, application data and other computer readable and executable instructions for execution by the processor 210 in order to control the light sources 220. The processor or controller 210 may be further configured to control the light sources 220 to change light attributes such as intensity and/or color, for example, in accordance with one or a combination of the described methods, which may be stored as computer readable and executable instructions in the memory 230 for execution by the processor 210.

The light sources 220 may be identified and displayed on a user interface 240, which may include a display device 250 configured to display and identify the light sources 220, such as displaying words or icons identifying each light source including its location. Illustratively, a map of the room 100 (shown in FIG. 1) is displayed on the display 250, including display of the light sources 220 at their respective locations. Of course, the map 100 may also include other devices in the room, such as the TV, couch, tables, spaces to be illuminated, etc.

The user interface 240 may be, for example, located near one of the light sources 220, on a hand-held remote controller, on a wall, and/or may include hard or soft switches such as displayed on the display screen 250 for control with any input device, such as a mouse or pointer in the case the screen is a touch sensitive screen. Further, touch sensitive elements (e.g., capacitively coupled strips or circular elements) of the user interface may be used to provide user input, such as to select the light sources forming the focus group, where the rest of the light sources are deemed to be in the surrounding group, as well as for selecting and or changing intensity values of light sources or ratios among the light sources and/or between the focus group and the surrounding group, for example.

The controller 210 may include any type of processor, controller, or control unit, for example. The controller or processor 210 is operationally coupled to the controllable light sources 220, which may be configurable to provide any type of light, such as direct or indirect light, having any desired attribute. Illustratively, the controllable light sources 220 include Light emitting diodes (LEDs) for controlling and changing attributes of light emanating therefrom. LEDs are particularly well suited light sources to controllably provide light of varying attributes, as LEDs may easily be configured to provide light with changing attributes, such as intensity, colors, hue, saturation, direction, focus and other attributes that may be controlled by the processor 210. Further, LEDs typically have electronic drive circuitry for control and adjustment of the various light attributes. However, any controllable light source may be used that is capable of providing lights of various attributes, such as different colors, hues, saturation and the like, such as incandescent, fluorescent, halogen, or high intensity discharge (HID) light and the like, which may have a ballast or drivers for control of the various light attributes.

It should be understood that the various components of the lighting control system 200 may be interconnected through a bus, for example, or operationally coupled to each other by any type of link, including wired or wireless link(s), for example. Further, the controller 210 and memory 230 may be centralized or distributed among the various system components where, for example, multiple LED light sources 220 may each have their own controller and/or memory.

Of course, as it would be apparent to one skilled in the art of communication in view of the present description, various further elements may be included in the system or network components for communication, such as transmitters, receivers, or transceivers, antennas, modulators, demodulators, converters, duplexers, filters, multiplexers etc. The communication or links among the various system components may be by any means, such as wired or wireless for example. The system elements may be separate or integrated together, such as with the processor. As is well-known, the processor executes instruction stored in the memory, for example, which may also store other data, such as predetermined or programmable settings related to system control.

Figure 3:
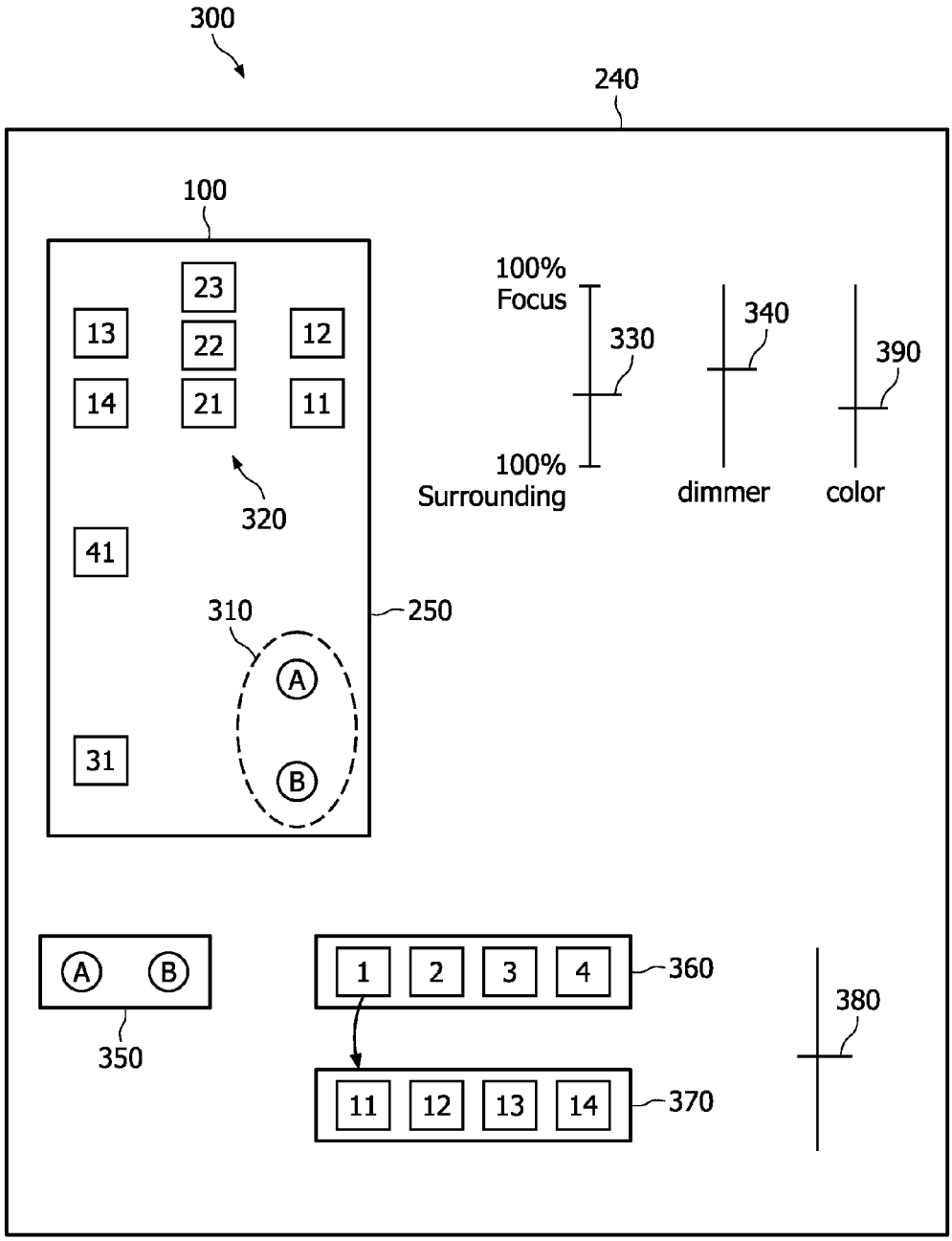
FIG. 3 shows an illustrative control device according to one embodiment.

FIG. 3 shows a control device 300 that includes the user interface 240 shown in FIG. 2. The control device 300 includes the display 250, for example, which may display the map 100 of the light sources in the space to be lit. The map 100 may also include other items of the space, such as furniture, windows, doors etc. Illustratively, the space or map 100 shown in FIG. 1 is displayed on the display device 250. The control device 300 further includes control elements such as switches, further displays etc, where the switches may be sliders, rotary knobs or soft switched displayed on the display device 250, and/or on further displays, and controlled using a mouse or other pointers including the user's finger in the case the display is a touch sensitive display.

On the display device 250, the user first selects the group of lights forming the main or focus activity, such as the reading lights 120, 122, which may be highlighted as a focus group 310. The focus group 310 may include one or more light sources such as the two light sources reference by A and B in circles, for example. All other light sources are then defined as being in a surrounding group 320 referenced by numerals in squares, for example. Illustratively, there are 4 groups of light sources 1, 2, 3, 4, in the surrounding group 320, where the first surrounding group 1 has four light sources 11, 12, 13, 14 (corresponding to light sources 140, 142, 144, 146 in FIG. 1); the second surrounding group 2 has three light sources 21, 22, 23 (corresponding to light sources 150, 152, 154 in FIG. 1); and the third and fourth surrounding groups 3, 4, each has one light source 31, 41, respectively, (corresponding to light sources 110, 130 in FIG. 1).

Next, the user selects and sets via the user interface 240 various control options, such as controlling an activity ratio switch 330, to select or set the light output ratio between the main activity or focus group 310 and the all other groups, namely, the surrounding group 320. The main ratio switch 330 is selectable between two end points, one end point being 100% focus-0% surrounding, and the other end point being 0% focus-100% surrounding. In addition, the user may also select control options related to the total light output, such as a total brightness, for example, via a dimmer switch 340.

Changing the activity ratio switch 330 changes the scene illumination ratio SIR between the focus group F and the rest or the surrounding group S, where SIR=F/S, without changing the intensity ratio or relationship among individual focus and/or surrounding light sources. For example, the focus group F may include three light sources with the following intensity levels, F[0.8, 0.3, 0.7] while the surrounding group S may include five light sources (or three groups of light sources) with the following intensity levels, S[0.4, 0.6, 0.2, 0.9, 0.3]. The relationships among the individual focus and/or surrounding light sources define or are associated with a particular scene, e.g., a reading scene. When the processor 210 or the user changes the scene illumination ratio, e.g., by changing or moving the activity ratio switch 330 then, for example the SIR changes from [90% focus, 60% surrounding] to [70% focus, 10% surrounding], which may be accomplished by multiplying the individual light intensities with different factors, to result in R1F[0.8, 0.3, 0.7] and R2S[0.4, 0.6, 0.2, 0.9, 0.3]. It should be noted that such an SIR change or multiplication does not change the relationship among the individual light intensities thus maintaining the scene effect, where the intensities of the light sources in the focus group are still related to each other by 8:3:7 and the intensities of the light sources in the surrounding group are still related to 4:6:2:9:3.

Similarly, changing the dimmer switch 340 changes the brightness or intensity of a scene formed by the focus and surrounding groups, without changing the individual light relationships in a group, as well as without changing the scene illumination ratio SIR, thus maintaining the light effect associated with the scene, e.g., a reading scene where the focus group F is selected or preset to include reading lights 120, 122 for group G2, configured to provide brighter light than light provided by the light sources of the surrounding group S. For example, changing the dimmer switch 340 multiplies both the focus and surrounding individual light intensities by the same factor, e.g., RF[0.8, 0.3, 0.7] and RS[0.4, 0.6, 0.2, 0.9, 0.3].

Both the scene illumination ratio SIR and the scene intensity may be changed simultaneously to go from a starting scene to an end scene, such as indirectly (through intermediate scenes) or directly, without going through intermediate scenes as described in connection with FIG. 4.

Figure 4:
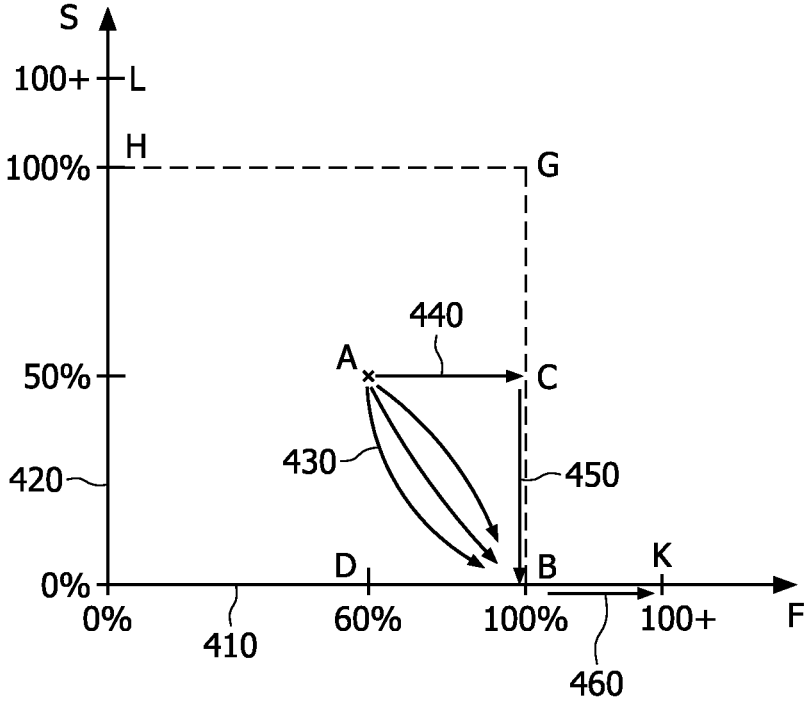
FIG. 4 shows a scene diagram of % focus versus % surroundings according to a further embodiment.

FIG. 4 shows a scene diagram where the percentage of the focus group F is shown on the x-axis 410 and the percentage of the surrounding group is shown on the y-axis 420, where 100% is defined as any lamp in the group operating at 100% or maximum intensity or brightness. Greater levels indicated as 100+ refer to the case where all light sources in a group are at their maximum brightness levels. FIG. 4 shows a pre-set or a starting scene A (selected and/or stored) at coordinates F=60% focus, S=50% surrounding resulting in a scene ratio SIR of 60/50. It should be noted that F+S need not equal 100.

When a user desires to change the starting scene A to an end scene B, e.g., with coordinates F=100% focus, S=0% surrounding, then several paths may be followed, which may be direct paths 430 where the focus and surrounding values F, S are changed simultaneously. Alternatively, indirect paths may be followed through intermediate scenes C or D, where the focus and surrounding values F, S are changed sequentially. For example, the first path 440 may be from scene A to an intermediate scene C, where S is kept constant, and F is increased, e.g., by multiplying intensity levels of lights sources in the focus group F by a factor R. A second path 450 may be followed from the intermediate scene C to the final or end scene B, by keeping F constant and reducing S, e.g., by multiplying intensity levels of lights sources in the surrounding group S by a factor 1/R. FIG. 4 also shows a further path 460 from B to point K 100+, where intensity values of all the light sources in the focus group F are further increased (e.g., by multiplication by R or a different factor) to 1 or maximum brightness.

Instead of using an indirect path though an intermediate point, such as going from an initial scene [F; S] having coordinates [100; 0] or point B in FIG. 4 to a final scene of [0,100] or point H, through intermediate point G having coordinates [100; 100], a direct path may be used, such as using linear interpolation using equal increments for example. Let say there are three light sources in each the focus group F and the surrounding group S, where the initial scene B [100, 0] has the following intensity values for the six light sources:

[1, 0.6, 0.5; 0, 0, 0], and the final scene H [0, 100] has the following intensity values:

[0, 0, 0; 1, 0.4, 0.3].

In the case of ten equal increments, then the first light source in the focus group is reduced from 1 to 0 in ten equal increments of 0.1; the second light source in the focus group is reduced from 0.6 to 0 in ten equal increments of 0.06; and the third light source in the focus group is reduced from 0.5 to 0 in ten equal increments of 0.5. Simultaneously, the first light source in the surrounding group is increased from 0 to 1 in ten equal increments of 0.1; the second light source in the surrounding group is increased from 0 to 0.4 in ten equal increments of 0.04; and the third light source in the surrounding group is increased from 0 to 0.3 in ten equal increments of 0.03.

Figure 5:
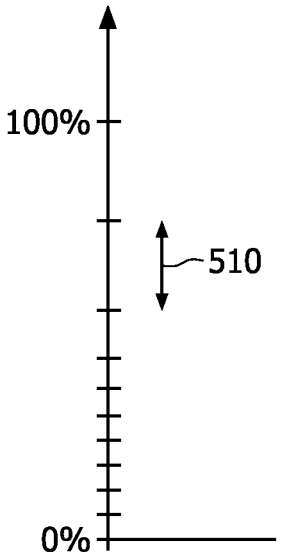
FIG. 5 shows an illustrative gradation of increasing increments with increasing intensity level according to a further embodiment.

Of course, instead of equal increments, unequal increments may be used where, for example, smaller increments are used for low intensity levels, and larger increments are used for larger intensity levels. The increase in the increment size 510 from low to high intensity values may follow an exponential relationship as shown in FIG. 5 or any other relationship such a logarithmic, square, or cube relationship and the like, for example.

It should be noted that Rmax (which is the value that results in all the light sources in a group (e.g., the focus group F) being at the maximum intensity level of 1 upon multiplication of the group by Rmax) is derived from the smallest intensity value. For example, if the smallest intensity value in a group is 7/10 or 0.7, then Rmax is 10/7, as seen from the following example, where intensity values greater then 1 are deemed to be 1:

[0.9, 0.7, 0.8]*(1/0.7)=[1, 1, 1]

Conversely, the value of R that results in all light sources in a group (e.g., the surrounding group S) to be at a minimum, e.g., 0.1, upon multiplication by 1/R is dependent of the highest intensity value in the group, as seen from the following example, where intensity values smaller then the minimum intensity level of 0.1 are deemed to be 0.1:

[0.7, 0.4, 0.1]*(0.1/0.7)=[0.1, 0.1, 0.1]

Typically, Rmax is the value that sets the intensity values of the all the light sources in the focus group F to maximum, e.g., 1, and sets the intensity values of the all the light sources in the surrounding group S to minimum, e.g., 0.1.

It should be noted that any type of direct path may be used in the space shown in FIG. 4, such as paths that are linear, curved, exponential, logarithmic, or any non-linear curve, such as a graphs having square, square root, cube or other relationships, which may be interpolated or extrapolated linearly or non-linearly, for example. Further, the change between scenes may be in continuous and/or stepwise, via any desired of increments, which may be equal increments or changing increments, that follow an exponential or other relationship, where for example, the increments between large brightness values are bigger than increments between smaller brightness values, which is more typically desirable and perceived as better by human observers.

It is desirable to create pleasurable light scenes by creating a focus on the main activity in a space. Such focus is created by using highest light levels in the area where this activity takes place and lower light levels in the surroundings. In this way, a pleasurable contrast is created. For example in a living room, the light fixtures may be grouped as follows: dining table group, TV group, couches and chairs group, paintings and sculptures group, curtains group, etc. In the case of dining in the living room, then it is desirable to have the most light above the dining table and lower light levels on all surrounding light fixtures (that is all other groups).

Returning to FIG. 3, the ratio switch 330 is configured to provide variable light level ratio between the main activity group (i.e., focus group 310), and all the other groups (i.e., surrounding group 320), and the dimmer switch 340 is configured to provide variable absolute light level of the main activity or focus group. In this way, the tedious setting procedure of each individual light source is reduced to controlling two variables. Also, processor executable instructions stored in the memory 230 may be used to provide the best practice solution of professional lighting designers, thus resulting in high quality solution. It should be understood that although slider switches are shown in the control device 300, any other type of switches may be used, such as rotary switched, and/or soft switches which may be displayed on the display device 250 or on further displays, for control with a mouse and/or pointer in the case of a touch sensitive screen 250. For example, instead or in addition to the ratio switch 330, a focus switch may be provided to change the focus between 100% and 0%, and a surrounding switch may be provided to change the surrounding between 100% and 0%.

Further controls and options may also be provided for better control of the quality of the results. For example, further interfaces 350, 360 may be provided, e.g., displayed on a screen which may be touch-sensitive. The interfaces 350, 360 may be configured to allow setting dimming ratios (also referred to as intensity ratios) among the different light sources of the focus group, e.g., lights sources A, B shown in interface 350, and among the different light sources of the surroundings group, e.g., the four different groups 1, 2, 3, 4 of the surroundings area or group 320, shown in interface 360.

Of course, preset ratios may be stored in the memory 230, where different preset ratios of light sources of the surrounding group depend on the selected focus group, i.e., depending on which main activity is selected. Further interfaces, such as an interface 370 may also be provided to select dimming ratios between or among the different light sources of a single group, such as among the four light sources 11, 12, 13, 14 of one light group (e.g., the general lighting for dining group G4 shown in FIG. 1) of the surrounding group 320.

Illustratively, upon clicking on or activating the first group key shown as numeral 1 in a square in the interface 360, then the interface 370 shows the light sources of the selected group, such as the four light sources 11, 12, 13, 14 included including in the group associated with numeral 1, being the dining general lighting sources. Now, the ratio or relationship among these four light sources 11, 12, 13, 14 may be selected or changed using a switch 380, for example, or any other interface, including display of numbers for control and change thereof to form a desired ratio or relationship among the four light sources 11, 12, 13, 14. Of course, if desired, any group of lights may be selected, whether in the surrounding group 320 or the focus group 310, to result in a display of the particular light sources included in the selected or activated group for control of the dimming/intensity ratio between or among these selected particular light sources.

In an illustrative example, if dining is selected as the main activity, then an associated preset dimming ratio for the surrounding groups [curtain:painting:reading:TV] maybe [0.50:0.50:0.20:0.20], respectively, where the numbers indicate the dimming levels (also referred to as intensity levels), such as 0.20 indicating the associated light source is at 20% brightness. That is, a zero level indicates minimum brightness, and 1 indicates maximum brightness. Of course, instead of a preset ratio pre-stored in the memory 230, such a ratio may be selected once during installation and stored in the memory 230. Each scene is defined by a particular combination of the various dimming or intensity levels, such as a reading scene, a dining scene, a romantic scene, a relaxing scene, etc. Various scenes may be pre-stored (and/or programmable) for easy selection by the user and fine tuning using the intuitive controls of the user interface 240.

In addition to the two main switches 330, 340 for focus: surrounding ratio control and total brightness control, a third main control switch 390 may be included on user interface 240 of the control device 300, in the case light sources or fixtures are used with controllable color or color temperature This third main control switch 390 may be a variable color temperature switch to change color between different colors, e.g., between cool white for the focus group, and warm white or a different color light for all groups together (i.e., the surrounding group).

There are several ways to create the light balance between the focus area and the surroundings. After selecting or defining the focus group to include selected light sources, for example, or starting from a pre-stored scene, such as a reading scene, one method of changing scenes and creating a desired light balance or scene includes multiplication of intensity levels associated with the light sources of the focus group F, and the light sources of the surrounding group S.

A simple example illustrates changing scenes by multiplication where, the focus group F includes three light sources and the surrounding group also includes three light sources having the following intensity levels, where intensity levels are given as fraction between 0 and 1 (or between 0% and 100%), 0 indicating minimum brightness or intensity and 1 (or 100%) indicating maximum brightness:

F[0.9; 0.7; 0.8]

S[0.7; 0.4; 0.1]

To change a scene, the focus group F is multiplied with a factor R and the surrounding group is multiplied with factor 1/R, R being a number between 1 and Rmax.

Rmax may be for example 10, 50 or 100. A method to automatically calculate Rmax in the system may be as follows:

Define:

1) $dim_{min,f}$=minimum dimming or intensity value used in focus group (initial value from pre-sets)
2) $dim_{max,s}$=maximum dimming or intensity value in surroundings group (initial value from pre-set)
3) $dim_{lowbound}$=minimum dimming or intensity value that can be used in the system (not equal zero).

Then Rmax is calculated from:

$$Rmax=\max(1/dimmin,f,dimmax,s/dimlowbound),$$

where 'max' is a function that calculates and outputs the maximum value of the two values between brackets.

To have the inverse light balance effect the factor R should vary between 1/50 (1/100, 1/10) and 1. If the computed dimming or intensity level is above the maximum possible value (usually 1) or below the minimum possible value (usually 0, or close to 0), it is replaced by this maximum or minimum value. The maximum number R that is needed is determined by the maximum dimming range of the focus group (being the difference between 1 and minimum dimming/intensity value) or of the surroundings group (being the difference between the maximum dimming/intensity value and zero). R may be given as an array of numbers, linearly distributed between its minimum and maximum values. Of course, other distributions may also be used.

There are many advantages of this multiplication method such as being simple to implement. Further, the scene impression of the focus group and of the surroundings group is kept intact as long as possible, because the dimming/intensity ratios or relationships are kept constant. Consider a dimming/intensity ratio for a scene with four light sources having the dimming/intensity values in the following array: [0.8, 0.6, 0.6, 0.7]. Multiplication of the array with a factor R, that is R*[0.8, 0.6, 0.6, 0.7], keeps the ratios or relationship among the dimming/intensity values intact (as long as they are not truncated to 1 (the maximum) or to 0 (or the minimum).

A further advantage of the simultaneous multiplication of the focus group by R and the surrounding group by 1/R is dispensing with the need for an intermediate point, contrary to the description below of the 'linear interpolation' and 'exponential interpolation' methods. This is a useful and practical advantage, making the application more intuitive for the user.

The multiplication method as described above, may also be used in another way as follows, where the light balance is increased in the following sequence:

1. multiply the focus group with factor R, increase R until one light source has an dimming/intensity value of 1 (or maximum); and
2. simultaneously multiply the surroundings group with factor 1/R until one light source has a minimal dimming/intensity value (e.g., 0.1).

At this point we have reached the maximum contrast between the focus group F and the surroundings group S with the same initial dimming/intensity ratios or relationships per group.

3. Multiply the surroundings group S with the factor 1/R until all the light sources have the minimal dimming/intensity value (e.g., 0.1); and
4. multiply the focus group with the factor R until all the light sources have the maximal dimming/intensity value (e.g., 1).

At this point we have reached the maximum contrast between the focus group and the surroundings group that is possible, where all surrounding lights are at the minimum level and the focus lights at the maximum level. Of course other sequences and permutations of these 4 steps may also be used.

For: F[0.9; 0.7; 0.8] and S[0.7; 0.4; 0.1];

if R is 1/0.9, then RF=[1; 0.7/9; 0.8/0.9] and S/R[0.63; 0.36; 0.09]

Since the intensity (or dimming) level of one of light sources (the first one) in the changed or new focus group RF is 1, then the x-coordinate of RF in the diagram shown in FIG. 4 is at 100% F. As described the 100+ level would be when all the intensity levels of all the light sources in RF are 1, i.e., RF[1; 1; 1], where any intensity value above 1 (or above a maximum level) is deemed to be 1. The highest value (0.63 or 63%) in the new surrounding group S/R may be deemed to be the S or y coordinate value for the scene diagram 400 in FIG. 4. That is, the new scene RF:S/R (for R=1/0.9) may have coordinates [100, 63], or [100%, 63%], or [1, 0.63].

For a scene where: F[0.9; 0.7; 0.8] and S[0.7; 0.4; 0.1];

if R is 0.7, then the new scene will have be RF=[0.64; 0.49; 0.56] and S/R[1; 0.3/0.7; 0.01/0.7]

Since the intensity (or dimming) level of one of the light sources (the first one) in the changed or new surrounding group S/R is 1, then the y-coordinate of S/R in the diagram shown in FIG. 4 is at 100% S. As described, the 100+ level would be when all the intensity levels of all the light sources in S/R are 1, i.e., S/R[1; 1; 1], where any intensity value above 1 (or above a maximum level) is deemed to be 1. The highest value in the new focus group may be deemed the F or x coordinate value for the scene diagram 400 in FIG. 4. That is, new scene RF:S/R (for R=0.7) may have coordinate [64, 100]. Of course, intensity values may be truncated or rounded so that RF=[0.64; 0.49; 0.56] and S/R[1; 0.3/0.7; 0.01/0.7] are truncated to RF=[0.6; 0.4; 0.5] and S/R[1; 0.4; 0.01] or rounded to RF=[0.6; 0.5; 0.6] and S/R[1; 0.4; 0.01].

It should be noted that multiplying the focus and surrounding groups F, S by R and 1/R, respectively, maintains the ratio among the individual light sources within the group in the case where the maximum 1 is reached for one of the light sources. However, the ratio SIR=F/S between the focus and surrounding groups F, S changes. Maximum contrast between the focus and surrounding groups F, S occurs when F is at the extreme maximum 100+ and S is at minimum, such as 0%, (designated as point K in FIG. 4 where all the light sources in the focus group F are at the maximum intensity 1), or when S is at the extreme maximum 100+% and F is at 0%, (designated as point L in FIG. 4 where all the light sources in the surrounding group S are at the maximum intensity 1). It should be noted that a minimum dimming value other than 0 may be used, such as 0.1, as lights source may not be dimmable to 0, where a value of 0 is typically the case when the lights are off. Of course, light sources may be turned off, instead of being dimmed to minimum level, to achieve a desired scene.

In addition or instead of the above described multiplication method, linear or non-linear interpolation may be used through an indirect path between two end points, such as end points B and H shown in FIG. 4, namely, between (100% focus, 0% surroundings) and (0% focus, 100% surroundings). For example, the indirect path may pass through intermediate point G, namely, (100% focus, 100% surroundings).

Illustratively, linear interpolation may be used to change scene B (100% focus, 0% surroundings) to scene G (100% focus, 100% surroundings), using N (for example in 10, 50, or 100) equal steps between 0% surroundings and 100% surroundings, at constant or 100% focus. Next, scene G (100% focus, 100% surroundings) is changed to scene H (0% focus, 100% surroundings) in N (for example in 10, 50 or 100) equal steps between 100% focus and 0% focus, at constant or 100% surroundings.

It should be noted that 100% means that at least one of the light sources in the group (focus or surroundings) has a dimming/intensity value of 100%. That is, the other light sources can have lower dimming/intensity values than 100%. It should also be noted that the dimming/intensity values for different light sources are typically not equal. For example: dimming/intensity levels of 100% focus may be the following: [0.3, 1.0, 0.5, 0.7]. 50% of this same scene is: 0.5*[0.3, 1.0, 0.5, 0.7]=[0.15, 0.5, 0.25, 0.35]. Linear interpolation between this 100% focus and its 50% focus setting including using N linearly equal steps from 0.3 to 0.15 for light source one, from 1.0 to 0.5 for light source two, etc.

As shown and described in connection with FIG. 5, instead of linear interpolation with N equal increments or steps, exponential distribution of dimming increments or steps may be used similar to the DALI standard, since human perception allows taking large steps when the light output increases. For example, going from scene B shown in FIG. 4 (100% focus, 0% surroundings) to scene G (100% focus, 100% surroundings), N (for example in 10, 50 or 100) exponential steps may be used from 0% surroundings of scene B to 100% surroundings of scene G. Next, from scene G (100% focus, 100% surroundings) to of scene H (0% focus, 100% surroundings), N (for example in 10, 50 or 100) exponential steps between 100% focus of scene G and 0% focus of scene H may be used. As noted, 100% means that at least one of the light sources in the group (focus or surroundings) has a dimming/intensity value of 100%; the others can have lower dimming/intensity values which, in general, are not equal.

The theory for this situation is described as follows (here it is described for the general situation with color mixing of Red Green and Blue (R, G, B) colors; dimming of only 1 color (white) is obtained by setting R=W=White and ignore G and B):

1. Assume we have 10 brightness steps and want to distribute these at a perceptual uniform mutual distance. Define absolute brightness for a single color (here we use color white, with index 'w') with equation (1):

$$\text{Bright}=f^{*}\text{Bright}_{max,w} \tag{1}$$

f being the fraction of white light (=dimming/intensity value); and $\text{Bright}_{max,w}$ being the maximum absolute brightness of the white light (in lumen output [lm]).

Now we have to find the distribution of f values such that perceptual uniform Brightness steps are made when changing brightness.

2. The perceptual uniform distribution of Brightness is described with an exponential function (similar as in the DALI standard for a single color) as shown in equation (2):

$$\text{Bright} = Bright_{max} * 10^{\left(\frac{i-1}{(NB-1)/ND}-ND\right)} \tag{2}$$

with "i" being a brightness level counter with a value between 1 and NB;

NB being the maximum number of brightness steps that is desired (here we assume 10); and ND being the number of decades that is wished between the minimum brightness level and the maximum brightness level; a good value is ND=2, thus f ranges between 0.01 and 1. Thus, as example, we now have defined the values $f_i$, with i=1 . . . 10 as shown in equation (3):

$$f_i = 10^{\left(\frac{i-1}{(NB-1)/ND}-ND\right)} = 10^{\left(\frac{i-1}{(10-1)/2}-2\right)} \tag{3}$$

For the linear interpolation and exponential interpolation methods described above, the (100% focus, 100% surroundings) point or scene G was used as intermediate setting. However, it can be more convenient to use another intermediate point (like (50% focus, 50% surroundings)). The intermediate point may be stored in the memory 230 (FIG. 2) as a pre-set, either pre-programmed before (as a factory setting) or during commissioning of the lighting network, or controlled by the user via the user interface 240. It should be noted that the intermediate point need not have equal percentages for the focus and surrounding groups. For example, the intermediate point between initial and final settings may also be for example (50% focus, 70% surroundings).

It is also possible to use the linear interpolation and exponential interpolation methods without intermediate point(s). In this case, there is interpolation between the starting scene or point, e.g., (100% focus, 0% surroundings) and the final scene/point, e.g., (0% focus, 100% surroundings). Additionally, it is possible, to 'extrapolate' a scene, where dimming/intensity values are increased in the focus group until all the focus lights (i.e., the lights in the focus group) have a dimming/intensity value of 1 or a maximum. Similarly, the dimming/intensity values in surroundings group are decreased until all the surrounding lights (i.e., the lights in the surrounding group) have the minimal dimming/intensity value, e.g., 0.1.

It should be noted that initial dimming/intensity values, as well as color values, for each scene that fit to the needs of certain activities in the space (like dining), e.g., as made by the user during commissioning of the lighting system, are stored in memory 230, referred to as pre-sets for use as a starting point for each variation of scene or light balance.

It is convenient and desirable to have a variable number $N=N_{var}$ of interpolation steps. $N_{var}$ depends on the lowest dimming/intensity value in the focus group or the maximum dimming/intensity value in the surroundings group.

In the case of linear interpolation, a fixed step size S, e.g., a number between 0 and 1, may be selected or set for use during interpolation. If the maximum dimming range in the scene in the focus group is called '$R_f$' (being the difference between 1 and minimum dimming value $dim_{min}$ of the focus scene), and in the surroundings group the maximum dimming range is '$R_s$' (being the difference between the maximum dimming value $dim_{max}$ in the surroundings group and zero), and $R_m$ is defined as the maximum of $R_f$ and $R_s$, then Nvar may be defined by equation (4):

$$Nvar=\text{round}(R_m)/S) \tag{4}$$

where the 'round' function means 'rounding to nearest integer'.

In such a case, the light balance function to change scenes may be used by either (1) changing the ratios of all dimming/intensity levels, or (2) keeping constant the ratios of all dimming/intensity levels, assuming that the light output of the light sources changes linearly with the changed dimming values.

(1) Changing the dimming/intensity level of each light source in the whole scene (focus+surroundings), e.g., changing with a stepwise dimming value change S (upward or down ward), results in changes in the ratios of all dimming/intensity levels; that is the ratios of all dimming/intensity levels are not kept constant.

(2) To keep the ratios of all dimming/intensity levels constant, the following may be performed:

(a) For the focus group: Change the dimming level of the light source that defines $R_f$ with a stepwise dimming/intensity value change S (upward or down ward); and calculate the dimming/intensity levels of all other light sources in the focus group from the initial dimming ratio (as long as the dimming value is not 1 or 0).

(b) For the surroundings group: Change the dimming level of the light source that defines $R_s$ with a stepwise dimming value change S (upward or down ward); and calculate the dimming levels of all other light sources in this group from the initial dimming ratio (as long as the dimming value is not 1 or 0).

In this way, the dimming ratios within the focus group and the surroundings group are kept as constant as possible. The advantage is that the focus group scene impression and the surroundings scene impression are kept constant as long as possible (like with normal dimming).

In case of exponential interpolation the approach is somewhat different:

1. Take a fixed scale of brightness levels of 1 (ND=1) or 2 (ND=2) decades depending on the value of $dim_{min}$, with NB chosen between 10 (perceived as discrete steps) and 100 (perceived as continuous steps) respectively:

If $dim_{min}>0.1$, then ND=1, else ND=2

2. Calculate the position 'i' on this scale for a dimming value 'dim' using the formula in equation (3) for each individual light source, as shown in equation (5):

$$i = \text{round}\left(1 + \left(\frac{NB-1}{ND}\right) * (ND + {}^{10}\log(dim))\right) \tag{5}$$

As noted, the 'round' function means rounding to the nearest integer.

The operation of the light balance light effect is now reduced to changing incrementally the position i on the brightness scale. The number of steps that is maximally needed is determined by $dim_{min}$ for the focus group or $dim_{max}$ for the surroundings group.

Alternatively, distinguish between focus group and surroundings group while keeping the dimming ratios per group as long as possible constant as follows:

(a) For the focus group: change the scale position 'i' as described, but only with the light source that defines $R_f$; calculate all other dimming levels in this group using the original dimming ratio of the pre-set.

(b) For the surroundings group: change the scale position 'i' as described, but only with the light source that defines $R_s$; calculate all other dimming levels in this group using the original dimming ratio of the pre-set.

Typically, it is desirable to use the light balance effect with interpolation methods in the interval between (100% focus, 0% surroundings) and the intermediate point. However, the inverse effect is also possible, by varying the scene between the intermediate point and an end point, such as starting/initial or final point, e.g., point or scene H (0% focus, 100% surroundings) shown in FIG. 4.

When assigning pre-sets, for each pre-set the user has to define which light sources belong to the "focus group"; all the other light sources automatically belong to the "surroundings group" for that pre-set. To help the user in this, the different light sources should first be configured during the commissioning phase in several subgroups (more than 2), referring to areas, objects, activities to which the subgroup of light sources is dominant, for example. Illustratively, groups may be defined as "dining table lights", "reading lights", "painting, art, flower lights", "general lighting" and the like, such as shown and described in connection with FIG. 1, for example. A focus group may include one or more of those subgroups.

The described methods provide simple solutions, such as allowing the user to fine-tune the preset and changed or created light effect, e.g., using a dimmer (in combination with a color selector if the lights sources provide changeable color) located in the space near a light source. The dimmer switch may be a software controlled device, including a hardware and/or a soft switch displayed on a display, for example.

The following are illustrative example for changing scenes and light balance, also referred to as contrast, including changing the ratio between the total amount of light in the focus group and in the surroundings group, where the sum of the two groups is not kept constant. Such methods and systems provide simple, intuitive and meaning full way to vary a light scene via a simple control method and user interface. The more light sources, e.g., larger than 3, then the more practical benefits are realized.

Table 1 shows examples related to the multiplication method. In particular, Table 1 shows data for a case describing the effect of the multiplication method. Each light sources is in either of two groups: 'focus' or 'surrounding' group. Each number is a value between 0 and 1, describing the dimming or intensity level of the light source; 0 means zero brightness and 1 is maximum brightness.

TABLE 1

| pre-set 1 | R | 1/R | | | | % focus | % surroundings |
|---|---|---|---|---|---|---|---|
| focus | 0.50 | 0.60 | 0.70 | | | 70 | |
| surroundings | 0.20 | 0.50 | 0.30 | 0.60 | 0.40 | | 60 |
| 100% focus | 0.71 | 0.86 | 1.00 | | | 100 | |
| 100% surroundings | 0.33 | 0.83 | 0.50 | 1.00 | 0.67 | | 100 |
| multiplication with R and 1/R | 0.10 | 10.00 | | | | | |

TABLE 1-continued

| pre-set 1 | R | 1/R | | | | % focus | % surroundings |
|---|---|---|---|---|---|---|---|
| focus | 0.05 | 0.06 | 0.07 | | | 7 | |
| surroundings | 2.00 | 5.00 | 3.00 | 6.00 | 4.00 | | 600 |
| surroundings corrected | 1.00 | 1.00 | 1.00 | 1.00 | 1.00 | | 100 |
| multiplication with R and 1/R | 0.40 | 2.50 | | | | | |
| focus | 0.20 | 0.24 | 0.28 | | | 28 | |
| surroundings | 0.50 | 1.25 | 0.75 | 1.50 | 1.00 | | 150 |
| surroundings corrected | 0.50 | 1.00 | 0.75 | 1.00 | 1.00 | | 100 |
| multiplication with R and 1/R | 1.1 | 0.91 | | | | | |
| focus | 0.55 | 0.66 | 0.77 | | | 77 | |
| surroundings | 0.18 | 0.45 | 0.27 | 0.55 | 0.36 | | 55 |
| multiplication with R and 1/R | 1.2 | 0.83 | | | | | |
| focus | 0.6 | 0.72 | 0.84 | | | 84 | |
| surroundings | 0.17 | 0.42 | 0.25 | 0.50 | 0.33 | | 50 |
| multiplication with R and 1/R | 1.43 | 0.70 | | | | | |
| focus | 0.71 | 0.86 | 1.00 | | | 100 | |
| surroundings | 0.14 | 0.35 | 0.21 | 0.42 | 0.28 | | 42 |
| multiplication with R and 1/R | 0.70 | 1.43 | | | | | |
| focus | 0.35 | 0.42 | 0.49 | | | 49 | |
| surroundings | 0.29 | 0.71 | 0.43 | 0.86 | 0.57 | | 86 |
| multiplication with R and 1/R | 2.00 | 0.50 | | | | | |
| focus | 1.00 | 1.20 | 1.40 | | | 140 | |
| surroundings | 0.10 | 0.25 | 0.15 | 0.30 | 0.20 | | 30 |
| focus corrected | 1.00 | 1.00 | 1.00 | | | 100 | |
| multiplication with R and 1/R | 5.00 | 0.20 | | | | | |
| focus | 2.50 | 3.00 | 3.50 | | | 350 | |
| surroundings | 0.04 | 0.10 | 0.06 | 0.12 | 0.08 | | 12 |
| focus corrected | 1.00 | 1.00 | 1.00 | | | 100 | |
| multiplication with R and 1/R | 10.00 | 0.10 | | | | | |
| focus | 5.00 | 6.00 | 7.00 | | | 700 | |
| surroundings | 0.02 | 0.05 | 0.03 | 0.06 | 0.04 | | 6 |
| focus corrected | 1.00 | 1.00 | 1.00 | | | 100 | |

The first row of Table 1 shows a pre-set, namely, 'pre-set 1' which is related to a space such as a living room, for example. The pre-set or selected focus group includes three light sources, as shown in column 2-4. The remaining light sources in the space or living room, namely five light source are then assigned to the surroundings group (e.g., row 3, columns 2-6 of Table 1). Column 7 labeled '% focus' is the largest intensity or dimming value of the focus group, namely, 70% or 0.70, while the last column or column 7 labeled '% surroundings is the largest intensity or dimming value of the surroundings group, namely, 60% or 0.60. That is, the starting or preset scene has coordinate [F, S] being [70, 60] in the diagram 400 shown in FIG. 4.

In particular, the (% focus, % surroundings) coordinates shown in the last two columns, i.e., columns 7-8, are calculated as follows:

% focus=maximum of dimming levels in focus group*100

% surroundings=maximum of dimming levels in surroundings group*100

As an example, the (100% focus, 100% surroundings) is given in rows 5-6 of Table 1, where at least one light source in each group has maximum intensity, e.g., 1. It should be noted that the ratio or relationship among light sources in each group of the (100% focus, 100% surroundings) is kept constant and the same as the preset. In particular, row 5 (labeled 100% focus) is obtained by multiplying row 2 (labeled focus) by 1/0.7, 0.7 being the largest intensity value of the preset focus group (row 2), and row 6 (labeled 100% surroundings) is obtained by multiplying row 3 (labeled surroundings) by 1/0.6, 0.6 being the largest intensity value of the preset surroundings group (row 3).

The rest of Table 1, shows the results of multiplying the focus group by R and the surroundings group by 1/R for 9 different factors R between 0.1 and 10. The dimming levels (columns 2-6) for each group are calculated as well as the (% focus, % surroundings) coordinates shown in the last two columns, namely columns 7-8.

The dimming levels shown in Table 1 include values above 1 (non-corrected). However, it should be noted that, typically in practice, values above 1 are set to 1, 1 being the maximum dimming level that a light source can have (by definition). The values above 1 have been kept in Table 1, to be able to better calculate (% focus, % surroundings) values to more clearly define the scene. However, it should be noted that the non-corrected coordinates, (% focus, % surroundings) shown in columns 7-8 having values above 100, do not unambiguously define the scene; i.e., these coordinates are combined with the dimming levels (columns 2-6) of the scene as described with the initial pre-set.

It should be noted that the coordinates (% focus, % surroundings) do not uniquely define the state of the lights. For example, point G in FIG. 4 (or point 2 in FIGS. 8 and 10-13) is at (100% focus, 100% surroundings); however different scene settings or states may be included for point G, such as defined by different intensity or dimming values in one or both the focus and surroundings groups. For example, two different focus scenes F1, F2, may be associated with point G or 100% focus, where F1=[0.7, 1, 0.3] and F2=[0.7, 1, 1]; thus both F1, F2 have % focus equal 100%, but F1 is not equal to F2. Such states may also depend on the pre-set of light settings that are multiplied with a factor R or 1/R, for example. Table 1 also shows corrected values where values above 1 or 100% are changed to 1 or 100%, respectively.

When the R*focus or (1/R)*surroundings multiplication gives a dimming level above 1, the dimming level in this light source is set to 1 (being the maximum). The % focus and/or % surroundings values for this case are larger then 100, which is useful for understanding the graphs shown in FIGS. 6-8, for example.

Figure 6:
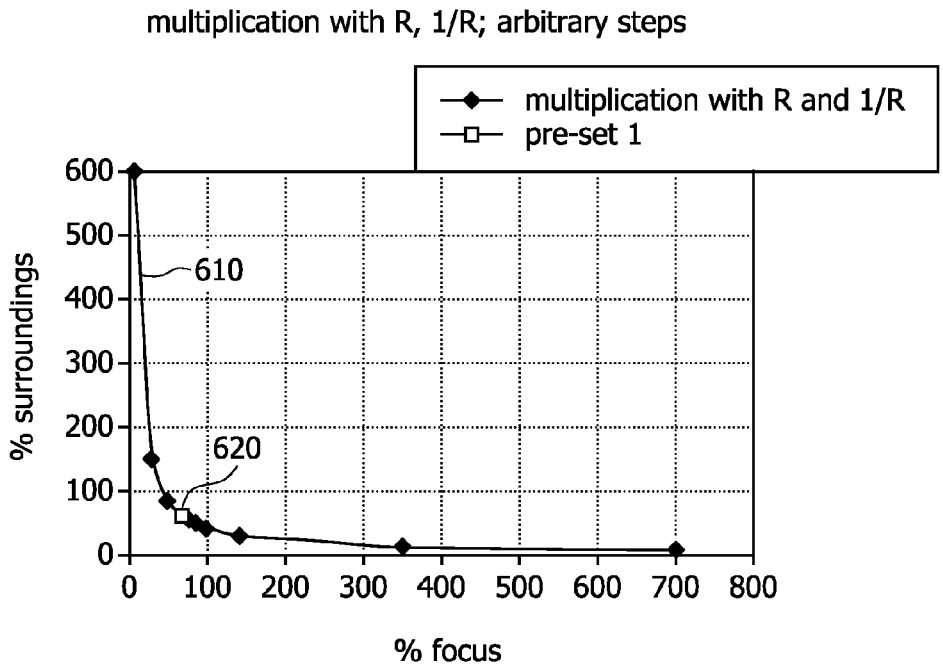
FIG. 6 shows another scene diagram including a curve of an exemplary % focus versus % surroundings according to another embodiment.

FIG. 6 shows a curve 610 in the (% focus, % surroundings) plot, as calculated in Table 1. The points left from the 'pre-set l' point 620 are for values R<1, and points right from this point 620 are for values R>1. The curved shape of the navigation trajectory in this plot is caused by the fact that the multiplication factor R is applied to the focus group simultaneously with multiplying the surroundings group with 1/R, and R ranging between 0.1 and 10.

Figure 7:
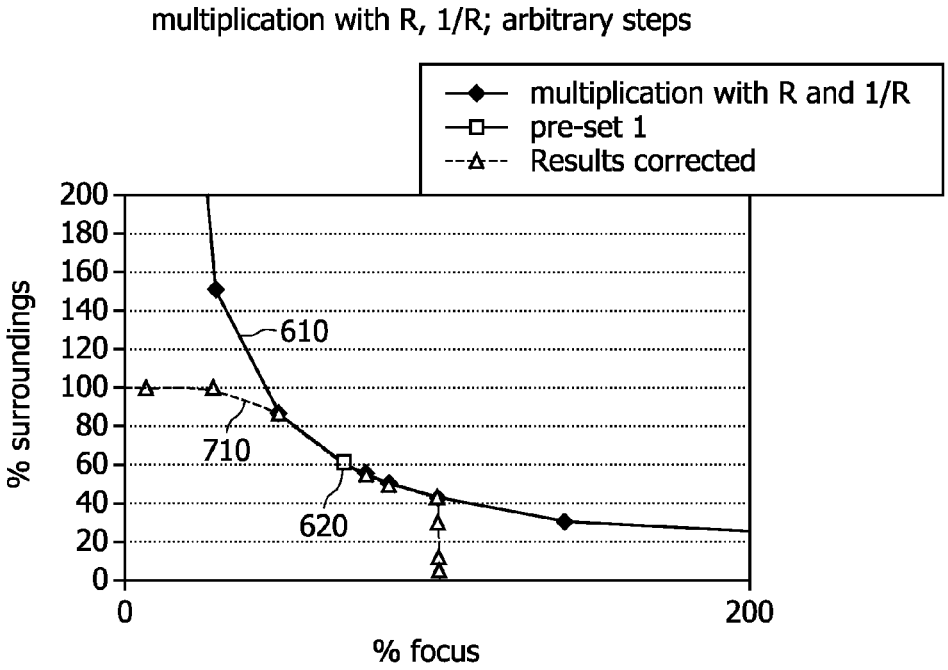
FIG. 7 shows a portion of the curve shown in FIG. 6 along with a corrected curve according to another embodiment.

If the dimming levels are corrected to be maximally 1, then a corrected curve is obtained, shown as 'Results corrected' curve 710 in FIG. 7.

Figure 8:
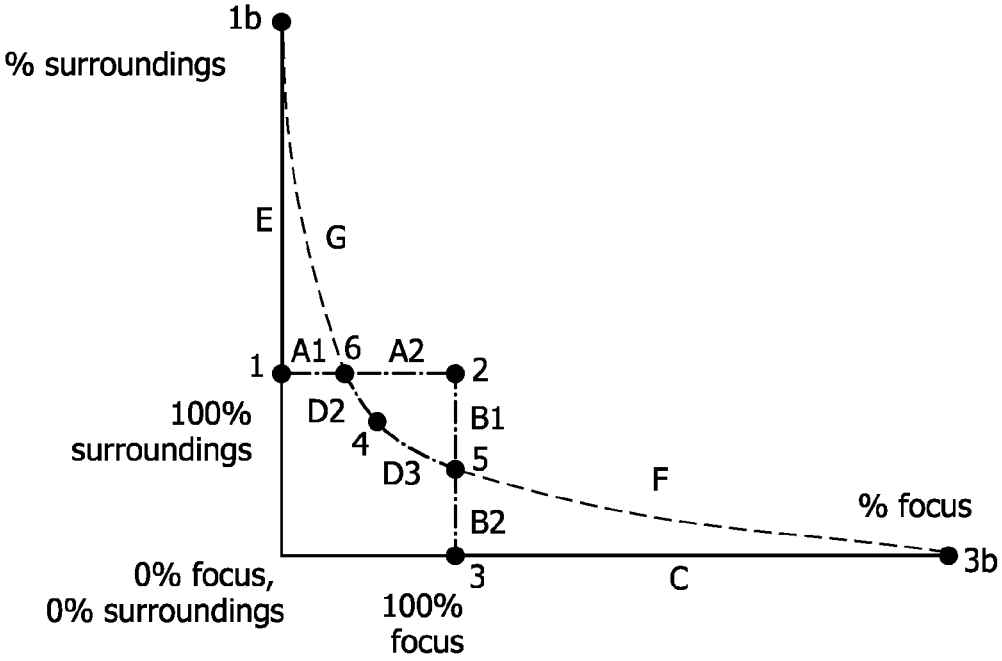
FIG. 8 shows a schematic drawing of FIG. 7 including various paths between points according to a further embodiment.

FIG. 8 is a schematic drawing of FIG. 7 showing various paths between points or scenes similar to those described in connection with FIG. 6. As shown in FIG. 8, navigation from point 4 (the starting pre-set), is either via paths D3 and B2 to point 5 and 3, or via paths D2 and A1 to point 6 and 1. The dotted curves F and G are not reached, due to the correction, namely, the cut-off of the maximum dimming or intensity levels at 1.

Other methods may also be used for changing scenes, e.g., from a preset or initial scene to a final scene. For example, instead of multiplication, scenes may be interpolated. Interpolation may be performed, for example, using linear or logarithmic distributions. The dimming levels may be changed in linear steps or increments, or in logarithmic steps where the step size increases from small to large for dimming levels increasing from small to large. The logarithmic distribution gives a gradual change as perceived by human observers.

Figure 9:
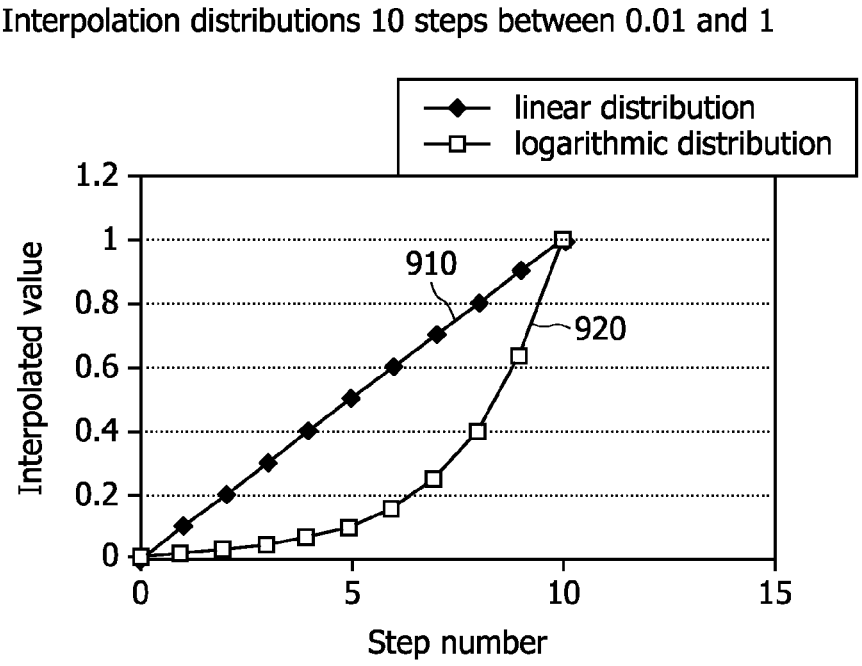
FIG. 9 shows curves of step numbers versus interpolated values according to a further embodiment.

FIG. 9 shows two distributions or curves of step numbers (x-axis) versus interpolated values (y-axis), namely a linear distribution or curve 910 and a logarithmic distribution 920.

When changing a scene via interpolation, in each group ("focus" or "surroundings") one light source is leading, such as the one with the maximum dimming range between the two end points of the interpolation trajectory in the (% focus, % surroundings) space. Upon selection the leading light source, then interpolation is done between the two states for this leading light source first. The dimming levels of all the other light sources in the same group are calculated from the ratio between the dimming level of the leading light source and the dimming level of the particular light source, as illustrated by the following example.

Let the pre-set or starting point be focus=[0.1, 0.5, 0.3] and the desired end-point to be interpolated be focus=[0.2, 1, 0.6]. The leading light source is selected as the one having the highest dimming or intensity level, which is the second light source having a pre-set value of 0.5. Thus, the second or leading light in the focus group will be changed, e.g. via interpolation, from 0.5 to 1.0.

Take the intermediate value 0.75; the dimming factor is then 0.75/0.5=1.5. Then the total focus scene is 1.5*[0.1 0.5 0.3]. It is desirable to keep the dimming ratios between the different dimming levels within a group constant as long as possible, because this defines the impression of the scene by human observers.

Figure 10:
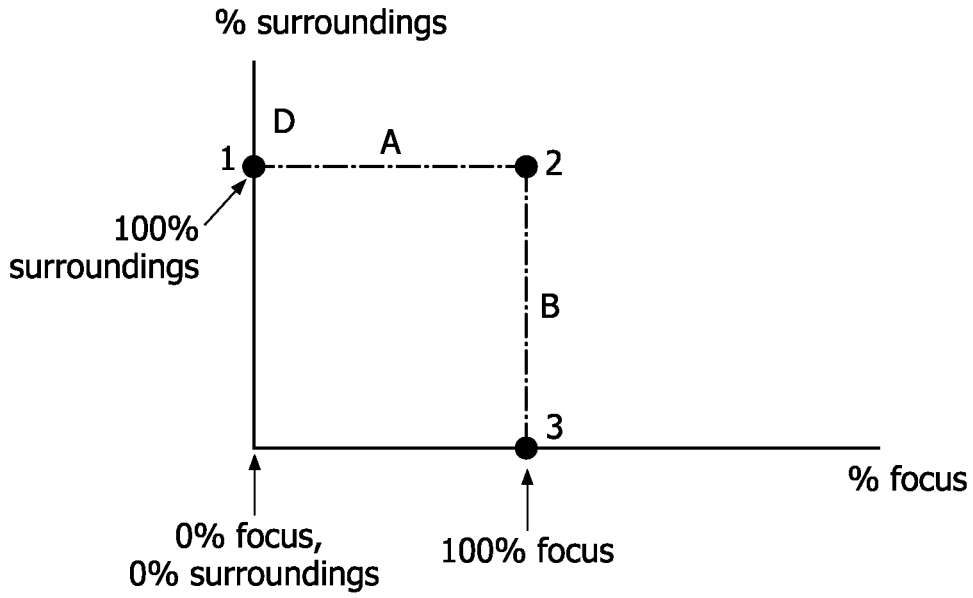
FIG. 10 shows the boundary of a scene diagram according to a further embodiment.

FIG. 10 shows the boundary made by lines A and B between point 1, 2 and 3. The boundary describes the maximum circumference of the (% focus, % surroundings) space that can be used.

Figure 11:
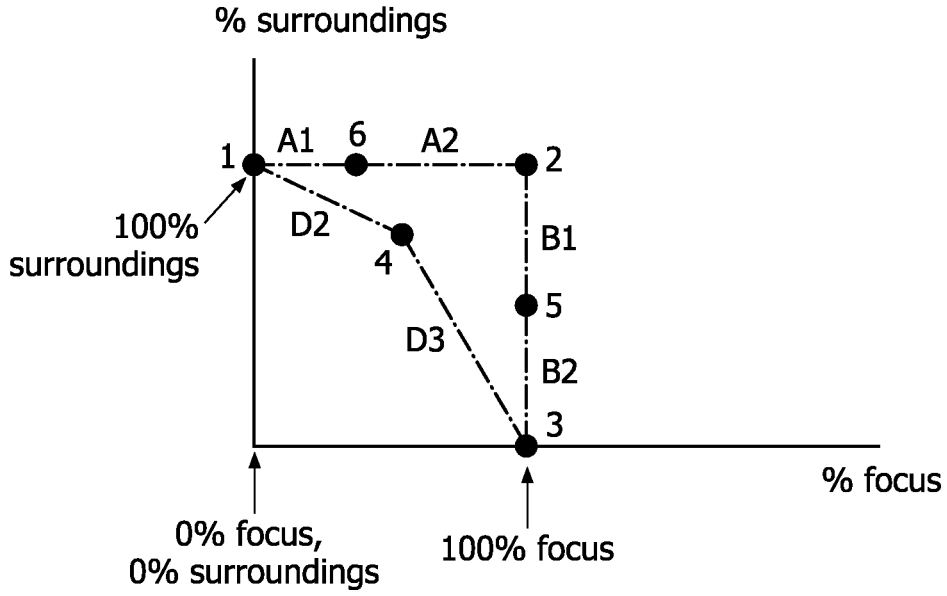
FIGS. 11-13 show interpolation of paths between various points or light scenes according to further embodiments.
Figure 12:
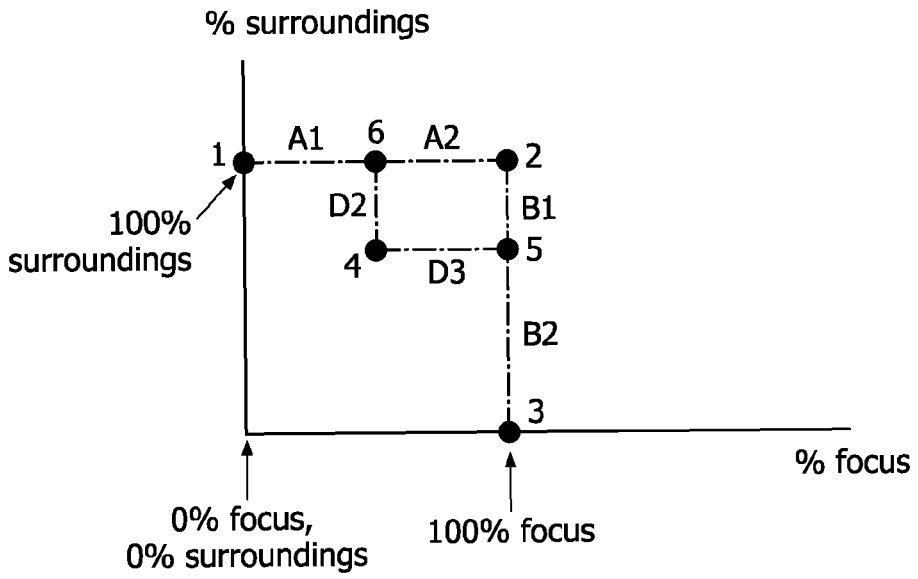
Figure 13:
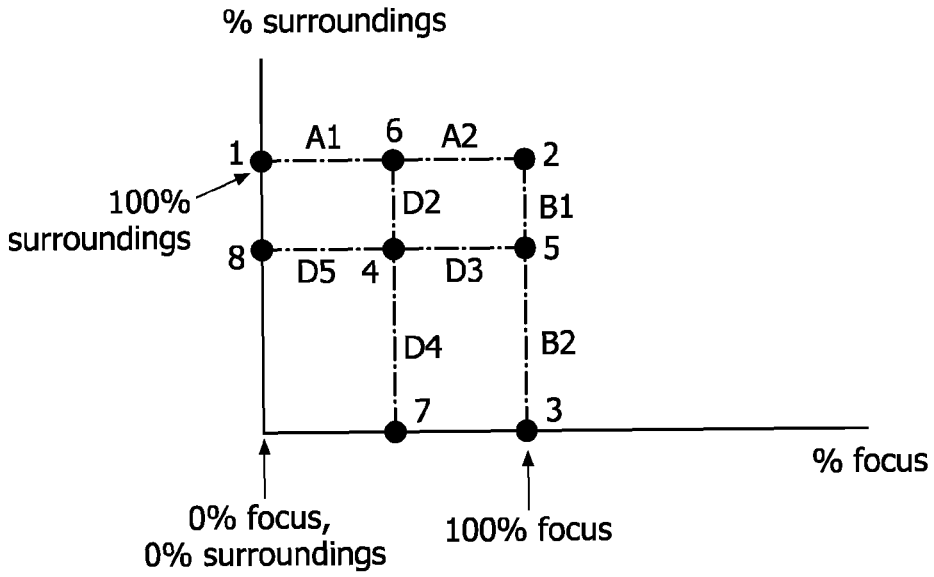

With interpolation methods, the interpolation trajectory in the (% focus, % surroundings) space has to be defined. The interpolation trajectory may be a segmented trajectory as well. This is shown in the graphs of FIGS. 11-13, where the pre-set or point 4 is the starting point of a scene variation via changing the contrast between the focus lighting group and the surrounding lighting group. It should be noted that the starting point 4 may be any point (stored and/or selected by a user) which is on or within the boundary described in FIG. 10, with % focus between 0 and 100 and % surroundings between 0 and 100. More generally, 0 may be described as a minimum value between 0 and 100, and 100 may be described as a maximum value between 0 and 100, but larger than the minimum value.

FIG. 11 shows interpolation between point 4 and either point 1 (via line D2) or point 3 (via line D3). During the interpolation and/or the change of scenes, the dimming levels may be changed in steps or increments which may be distributed in various ways, such as using linear distributions and/or exponential distributions. Since it is desirable to either increase the focus lighting relative to the surroundings lighting, or the other way around, then it is logical to move from point 4 (the pre-set) to the point 3 (100% focus, 0% surroundings), or to point 1 (0% focus, 100% surroundings).

Points 1 and 3 in FIG. 11 are defined by:

Point 1: 100% focus: focus group of pre-set scaled with its maximum dimming value; and Point 2: 100% surroundings: surroundings group of pre-set scaled with its maximum dimming value.

Scenes may also be 'extrapolated' by changing the dimming values beyond these defined points. It should be noted that due to the correction or the cutting-off of the dimming levels at maximum 1, the mapping of the scene in the (% focus, % surroundings) graphs stays the same point.

For the example where focus=[0.5 0.25 0], then % focus equals 100 if focus=[1, 0.5, 0], i.e., where one of the light source in the group is at maximum intensity. The % focus of [1, 0.5, 0] may be extrapolated to 200% focus where focus=[2, 1, 0]. However, due to correction, namely, capping off the dimming or intensity values to 1 changes [2, 1, 0] to [1, 1, 0] which also has coordinate % focus equal 100, since at least one of the light sources in the group is at the maximum intensity.

Another example demonstrates interpolation from point 4 to 3.

Let: pre-set, point 4: focus=[0.1, 0.5, 0.3], and surroundings=[0.2, 0.4];

Then: the total scene at point 4=[focus; surroundings]=[0.1, 0.5, 0.3; 0.2, 0.4]

For point 3: let focus=[0.2, 1, 0.6]; surroundings=[0, 0];

Then the total scene at point 3=[focus surroundings]=[0.2, 1, 0.6; 0.0, 0.0]

In the focus group, the second light source is the leading source, since it is the dimming or intensity value is the highest in the group and goes up from 0.5 to 1. Thus, interpolated values are calculated for this leading dimming value to go up from 0.5 to 1. The other interpolated dimming values are obtained from the leading dimming value, so that the ratios between the other dimming values and the leading dimming value is kept constant, and thus the scene impression remains substantially constant (assuming the light sources respond linearly to the dimming values and produce light output having an intensity that substantially coincides to the set dimming value and changes proportionally with changes to the dimming value). Similarly, in the surroundings group, the dimming value that decreases from 0.4 to 0 is the leading dimming level, since 0.4 is the highest dimming or intensity value in the group and goes from 0.4 to 0.

FIG. 12 shows another trajectory for changing or creating contrast or light balance between the lighting in the focus group and the surroundings group. FIG. 12 includes straight line segments parallel with one of the axes. Navigation along these line segments may be done via either the interpolation or the multiplication method. Both methods act similarly here because, in this case, the multiplication method does not involve simultaneous multiplication of both the focus and surroundings groups (by R and 1/R, respectively). Rather, in this case, the multiplication method involves multiplying only one group, i.e., multiplying only either the focus group or the surroundings group, while keeping the other group constant.

In FIG. 12, point 4 is the pre-set, that is the starting point for contrast variation between the focus lighting group and the surrounding lighting group. Increasing the focus lighting only is done via line D3 from point 4 to 5, then the surrounding lighting is decreased from point 5 to point 3 via line B2. At point 3, the contrast may be increased further by increasing all dimming levels (of all the light sources) in the focus group to 1 and all dimming levels in the surroundings group to minimum (e.g., to zero).

Similarly, starting from point 4 in FIG. 12, the surroundings lighting only may be increased via line D2 from point 4 to 6. The contrast may be increased further via line A1 from point 6 to point 1 by reducing the focus group lighting. At point 1, the contrast may be increased further by increasing the surroundings lighting until all the dimming values are maximum (e.g., 1) and reducing the focus lighting until all dimming levels are minimum (e.g., 0).

FIG. 13 shows dimming the surroundings from the pre-set (i.e., point 4) to point 7 along line D4 which may be interpreted as an "energy saving" method, since the focus lighting is kept constant and the surrounding lighting only are dimmed. Since the focus lighting group supports the main activity and requires the pre-set lighting (or maybe even more light), focus lighting group should not be changed during energy savings; instead only the intensity values of the lights sources of the surroundings group should be lowered. Such an energy saving function may be provided on the user interface as a green knob, for example, a green push button, that (when pushed) sequentially changes the light setting according several discrete points along line D4.

Of course, dimming the focus group along line D5 from the pre-set point 4 to point 8 also provides energy savings, but typically this is less meaningful or useful since the intensity values of the focus lighting group are reduced which is not desirable, since this is contrary to the purpose of providing more light for the main or focus activity as compared to the surroundings group. It should be noted that any change along a vertical path in FIG. 13 is a meaningful energy saving mode, where the light levels of the surroundings group are reduced. Such energy saving paths include paths B1 and B2, where these paths B1, B2 do not include the pre-set as a starting point, for example. Many other variations and paths may be used, such as moving from point 4 in the direction of the point (0% focus, 0% surroundings), by dimming both focus and surroundings groups, either simultaneously or sequentially, by the same or different amounts. That is, it is not necessary to dim the focus and surroundings groups with the same amount where both groups are multiplied with the same factor.

In general, one of the most useful dimming situations include starting from a pre-set scene, and only change, e.g., dim/reduce or increase, the surroundings group, where the focus group is kept constant. This is, for example, useful when the amount of daylight in a space is variable. With enough daylight, the surroundings lights may be dimmed while the focus groups is kept at a constant light level to ensure enough light for the dominant task or activity. When daylight becomes less, the surroundings group becomes more important and their light levels may be increased for optimal atmosphere creation as, typically, it is not comfortable to sit in a room that is strongly lit at one location and dark around it. On the other hand, if users want to save energy, they are free to dim the surroundings group, since this group is not necessary for doing the main or focus activity or task (e.g. reading).

When a group (either focus or surroundings) is increased or dimmed until one of the borders of the control space is reached (these borders define the square with corner points (0% focus, 0% surroundings) (100% focus, 0% surroundings) (100% focus, 100% surroundings) (0% focus, 100% surroundings) as shown in FIG. 10), one optimal user experience is obtained if all the lights in this group get at their maximum (in case of increasing) or at their minimum (in case of dimming) at the same time. Thus, "100% focus" in this case means all lights in focus group are at 100% (not just one light), and "0% focus" means all lights in focus group are at 0%; similar rules apply to the surroundings group.

It should be noted that the described light effects, e.g., the contrast between the focus lighting group and the surroundings lighting group, are typically combined with normal dimming via a separate control knob, e.g., slider, push button, or other types of controls, such as the total dimmer switch 340 of the user interface 240 shown in FIG. 3.

The effect of total dimming on a scene may be described as follows, using the multiplication method as an example:

(1) take R as the multiplication factor for the dimming or intensity values of the focus group (named 'focus' below), and 1/R as the multiplication factor for the dimming/intensity values of the surroundings group (named 'surroundings' below);

(2) take D as the normal dimming multiplication factor for the whole scene, e.g., dimmer switch 340 in FIG. 3, being a number between 0 and 1, (3) the, the total scene may be described by:

$$\text{dimming values of scene}=D^*[R^*\text{focus}+1/R^*\text{surroundings}]$$

The correction factor should be kept in mind, namely, that when a value in the terms R*focus and 1/R*surroundings is larger than 1, then it is set to 1, for example.

Various modifications may also be provided as recognized by those skilled in the art in view of the description herein. The operation acts of the present methods are particularly suited to be carried out by a computer software program. The application data and other data are received by the controller or processor for configuring it to perform operation acts in accordance with the present systems and methods. Such software, application data as well as other data may of course be embodied in a computer-readable medium, such as an integrated chip, a peripheral device or memory, such as the memory 230 or other memory coupled to the processor 210.

The computer-readable medium and/or memory may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or memory.

Additional memories may also be used. The computer-readable medium, the memory, and/or any other memories may be long-term, short-term, or a combination of long-and-short term memories. These memories configure the processor/controller to implement the methods, operational acts, and functions disclosed herein. The memories may be distributed or local and the processor, where additional processors may be provided, may be distributed or singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network, such as the Internet, is still within memory, for instance, because the processor may retrieve the information from the network.

The controllers/processors and the memories may be any type. The processor may be capable of performing the various described operations and executing instructions stored in the memory. The processor may be an application-specific or general-use integrated circuit(s). Further, the processor may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for changing ratios or scenes may be utilized in conjunction with further systems.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;
b) the word "a" or "an" preceding an element does not exclude the presence of a plurality of such elements;
c) any reference signs in the claims do not limit their scope;
d) several "means" may be represented by the same or different item or hardware or software implemented structure or function;
e) any of the disclosed elements may be comprised of hardware portions (e.g., including discrete and integrated electronic circuitry), software portions (e.g., computer programming), and any combination thereof;
f) hardware portions may be comprised of one or both of analog and digital portions;
g) any of the disclosed devices or portions thereof may be combined together or separated into further portions unless specifically stated otherwise;
h) no specific sequence of acts or steps is intended to be required unless specifically indicated; and
i) the term "plurality of" an element includes two or more of the claimed element, and does not imply any particular range of number of elements; that is, a plurality of elements may be as few as two elements, and may include an immeasurable number of elements.

The invention claimed is:

1. A lighting system comprising:

a plurality of light sources configured to provide light and grouped into different groups, each of said different groups having a plurality of light sources;

a controller configured to divide the light sources into a focus group including focus light sources for providing main light, and a surrounding group including surrounding light sources for providing background light;

an activity ratio input read by the controller;

wherein the focus light sources in said focus group have individual focus intensity levels related to each other according to a first relationship, the surrounding light sources in said surrounding group have individual surrounding intensity levels related to each other according to a second relationship;

wherein said controller is configured to change a ratio of the focus group to the surrounding group according to the activity ratio input without changing the first relationship and the second relationship.

2. The lighting system of claim 1, wherein the controller is further configured to change the ratio between a first end point having a first coordinate and a second end point having a second coordinate.

3. The lighting stem of claim 2, wherein the first coordinate is about 100% focus and 100% surrounding, and the second coordinate is about 0% focus and 0% surrounding;

wherein the 100% focus includes at least one of all focus light sources in the focus group set at a maximum setting, and one focus light source in the focus group set at the maximum setting; and wherein the 100% surrounding includes at least one of all surrounding light sources in the surrounding group set at the maximum setting, and one surrounding light source in the surrounding group set at the maximum setting.

4. The lighting system of claim 2, wherein the first coordinate includes a scene coordinate (F1, S1) and is a pre-set coordinate stored in and selectable from a memory, and the second coordinate is a scene coordinate (F1, 0% surrounding intensity).

5. The lighting system of claim 1, wherein the controller is configured to change the ratio by multiplying the individual focus intensity levels by a factor (R) and simultaneously multiplying the individual surrounding intensity levels by an inverse of the factor (1/R).

6. The lighting system of claim 1, wherein the controller is configured to change the ratio by at least one of interpolation and multiplying by a factor at least one of the individual focus intensity levels and the individual surrounding intensity levels.

7. The lighting system of claim 1, wherein the controller is configured to change total intensity without changing the ratio, the first relationship, and the second first relationship.

8. The lighting system of claim 1, wherein the controller is configured to change total intensity without changing the ratio, the first relationship, and the second first relationship by multiplying by a factor both the individual focus intensity levels and the individual surrounding intensity levels.

9. The lighting system of claim 1, wherein the ratio is selectable between a first end point being 100% focus and 0% surrounding, and a second end point being 0% focus and 100% surrounding;

wherein at the first end point, at least one focus light source in the focus group is set at a maximum intensity level, and at least one surrounding light source in the surrounding group is set at a minimum intensity level; and wherein at the second end point least one focus light source in the focus group is set at a minimum intensity level, and at least one surrounding light source in the surrounding group is set at a maximum intensity level.

10. The lighting system of claim 1, wherein the controller is further configured to change an intensity level of light source from a first value to a second value level in equal or exponentially growing increments.

11. A method of controlling light sources configured to provide light, the method comprising the acts of:

dividing the light sources into a focus group including a plurality of focus light sources for providing main light and a surrounding group including a plurality of surrounding light sources for providing background light, wherein the focus light sources have individual focus intensity levels related to each other according to a first relationship, and the surrounding light sources have individual surrounding intensity levels related to each other according to a second relationship; and changing a ratio of the focus group to the surrounding group without changing the first relationship and the second relationship.

12. The method of claim 11, further comprising the act of changing the ratio between a first end point having a first coordinate and a second end point having a second coordinate.

* * * * *